US006633738B2

(12) United States Patent
Litwiller

(10) Patent No.: US 6,633,738 B2
(45) Date of Patent: Oct. 14, 2003

(54) SELF-CLEANING MECHANISM ENABLING VISIBILITY INTO CONTAINERS OF PARTICLES

(75) Inventor: Debora M. Litwiller, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/022,229

(22) Filed: Dec. 20, 2001

(65) Prior Publication Data

US 2003/0118375 A1 Jun. 26, 2003

(51) Int. Cl.[7] ..... G03G 15/08
(52) U.S. Cl. ..... 399/262; 399/263
(58) Field of Search ..... 399/254, 255, 399/256, 258, 260, 262, 263

(56) References Cited

U.S. PATENT DOCUMENTS

| | | | | |
|---|---|---|---|---|
| 4,739,907 A | | 4/1988 | Gallant | 222/240 |
| 5,495,323 A | | 2/1996 | Meetze, Jr. | |
| 5,500,719 A | | 3/1996 | Ichikawa | |
| 5,574,179 A | | 11/1996 | Wahl et al. | 554/110 |
| 5,576,816 A | | 11/1996 | Staudt et al. | |
| 5,655,195 A | * | 8/1997 | Ichikawa et al. | 399/263 |
| 5,678,121 A | | 10/1997 | Meetze, Jr. et al. | 399/12 |
| 5,903,806 A | | 5/1999 | Matsuoka et al. | 399/258 |
| 5,942,484 A | | 8/1999 | Roetker et al. | 510/426 |
| 6,169,864 B1 | | 1/2001 | Baxendell et al. | 399/106 |
| 6,424,812 B1 | * | 7/2002 | Hsu | 399/262 |

* cited by examiner

*Primary Examiner*—William J. Royer
(74) *Attorney, Agent, or Firm*—Rickard F. Spooner

(57) ABSTRACT

This invention relates to the packaging and subsequent removal of particulate matter that tends to stick in its storage container. Particular application of the present invention is to cartridges for storing marking materials such as electrophotographic toners and solid ink jet inks. A mechanism and process for increasing visibility into a container holding particulate matter is disclosed. The cleaning mechanism includes a drive mechanism capable of moving a cleaning member proximate to the inside surface of the container.

25 Claims, 6 Drawing Sheets

SELF-CLEANING MECHANISM ENABLING VISIBILITY INTO CONTAINERS OF PARTICLES

CROSS REFERENCE TO RELATED APPLICATIONS

Reference is made to commonly-assigned copending U.S. patent application No. 10/022,227, filed concurrently herewith, entitled: INTERNAL AGITATING MECHANISM FOR AGITATING MATERIALS WITHIN SEALED CONTAINERS, by Litwiller.

BACKGROUND OF THE INVENTION

This invention relates to the packaging and subsequent removal of material that tends to stick to the inside perimeter of containers and to thereby prevent viewing of the contents inside the containers. The invention is particularly applicable when such attachment of particles to the container sides is due primarily to electrostatic forces. Many particulate materials are packaged and shipped in plastic, glass, or similar smooth-sided containers. When human users dump or other-wise transfer particle contents from a nearly transparent shipping container, the common experience is a desire to see inside the container in order to see how much of the contents have been removed. If the intent is to remove all of the contents, then such viewing is to see whether all contents have been removed. However, if a thin layer of particles have attached themselves to the inside walls of the container, then such viewing is made difficult or impossible. The problem becomes more frustrating when the particulate matter is light-weight and, accordingly, difficult to determine by heft whether the contents have been dumped. Even more frustration occurs when the container is first fastened to a receiving receptacle before the contents are removed. Since the container is fastened in place, its heft cannot be easily determined. Although containers filled with other particulate or granulated products may benefit from the present invention, including without limitation, pelletized or granulating marking materials such as waxy inks, the invention will be explained in reference to electrophotographic toners, or other dry inks and marking materials. Typical electrophotographic toners are stored and transported in nearly transparent plastic bottles. The process of transferring toners from such toner bottles or cartridges occurs after the bottle has been affixed to a receiving receptacle The toner particles themselves are light and fluffy. Moreover, toner particles are designed to readily accept electrostatic charges. Hence, the agitation and shaking of toner bottles that is recommended prior to loading the cartridges onto printing machines typically induces charges in the particles that cause at least a thin film of particles to adhere to the inside walls of their containers. The combined result is that it is very difficult to determine whether all the contents of a toner bottle have been transferred from the toner bottle to the receiving receptacle of a printing system. Many user observations document users attempting to shake, tap, and otherwise agitate the bottle while it is fastened to the printing machine. Users also commonly attempt to peer into the battle. All these are attempts to ensure that the contents of the bottle have transferred. And for the reasons described above, most users who attempt such verification are unable to make the determination. Observations confirm persistent user frustration at not being able to visually or manually detect whether all toner particles have been transferred.

The following is a background description of the nature of electrostatic toners: Generally, in the process of electrostatographic printing, a photaconductive insulating member is charged to a substantially uniform potential to sensitize the surface thereof. The charged portion of the photoconductive insulating member is thereafter exposed to a light image of an original document to be reproduced. This records an electrostatic latent image on the photoconductive insulating member corresponding to the information areas contained within the original document. Alternatively, in a printing application, the electrostatic latent image may be created electronically by exposure of the charged photoconductive insulating member by an electronically controlled laser beam or light emitting diodes. After recording the electrostatic latent image on the photoconductive insulating member, the electrostatic latent image is developed by bringing a developer material charged of opposite polarity into contact therewith. In such processes the developer material may comprise a mixture of carrier particles and toner particles or toner particles alone (both these single component and dual component development systems shall hereinafter be called "toner"). Toner particles are attracted to the electrostatic latent image to form a toner powder image that is subsequently transferred to a copy sheet and thereafter permanently affixed to the copy sheet by fusing.

In such printing machines, the toner material is consumed in a development process and must be periodically replaced within the development system in order to sustain continuous operation of the machine. Various techniques have been used in the past to replenish the toner supply. Initially, new toner material was added directly from supply bottles or containers by pouring to a developer station located within the body of an automatic reproducing machine. The addition of such gross amounts of toner material altered the triboelectric relationship between the toner and the carrier in the developer station, thereby resulting in reduced charging efficiency of the individual toner particles and accordingly a reduction of the development efficiency when developing an electrostatographic latent image on an image bearing surface. In addition, the pouring process was both wasteful and dirty in that some of the toner particles became airborne and would tend to migrate into the surrounding area and other parts of the machine. Accordingly, separate toner hoppers with a dispensing mechanism for adding the toner from the hopper to the developer station in the printing machines on a regular or as needed basis have been provided. In addition, it has become common practice to provide replenishment toner supplies in a sealed container that, when placed in the printing machine, can be automatically opened to dispense toner into the toner hopper. In some of these designs, the toner cartridge may itself serve as the toner hopper. After this type of toner cartridge is mated to the printing machine at an appropriate receptacle, mechanisms are inserted into the toner cartridge that serve to transport the toner from the toner cartridge into the developer station or an intermediate toner hopper on a regulated basis. See, U.S. Pat. No. 5,903,806 issued to Matsunka et al.; U.S. Pat. No. 5,678,121 issued to Meetze et al.; and U.S. Pat. No. 5,495,323 issued to Meetze. In other designs, the toner cartridge is mated to the appropriate receptacle of the printing machine and then toner is dumped all at once from the toner cartridge into a toner hopper within the printing machine. Such toner in the hopper is then drawn into the developer station on a regulated basis. The toner cartridge, once its contents are dumped, is removed from the receiving receptacle and is either discarded or recycled.

In any design utilizing a customer replaceable toner cartridge for replenishment, one difficulty that arises is ensuring that all toner has been removed from the cartridge.

This difficulty has two aspects: First, as described above, it is difficult to detect whether all toner has been removed from the cartridge. This is partly because toners in small quantities weigh little and are therefore difficult to detect by sensing their weight. More importantly, toner particles are designed to efficiently accept electrostatic charges with the result that they typically coat the inside surfaces of toner cartridges, thereby making the cartridges opaque.

The second difficulty in ensuring that all toners have been removed from a toner cartridge is the tendency of toner particles settle and clump during shipment and storage. This clumping phenomenon is caused for a variety of reasons: 1) particles of smaller size can fill and pack spaces between larger particles: 2) toner particles are often tacky; and 3) the electrostatic properties of toner particles enable charge attractions between particles. The result is often agglomerations, or clumps, of particles within the toner cartridge. These agglomerations often compact and form bridging structures within the toner cartridge, and such bridging structures adhere to the sides of the toner cartridges. Simple probes and augers as disclosed in patents such as U.S. Pat. No. 5,903,806 issued to Matsunka et al., U.S. Pat. No. 5,678,121 issued to Meetze at al., and U.S. Pat. No. 5,495,323 issued to Meetze may penetrate such agglomerations and bridging structures but do not break them up. Even rotation of the cartridges after mating onto a printing machine toner receptacle does not impart enough energy to shake the clumped toner particles apart from its various clumps and bridging structures. Since toner cost is a major component of the total cost of printing, any significant amount of toner left in a toner cartridge significantly increases the effective cost of using the printer. Worse, customers that do not receive the expected print volume from a cartridge and that cannot see whether a cartridge has in fact been emptied may assume that the cartridge is faulty and make a warranty claim. In other cases, such customers have been known to make a service call that consumes valuable service and technician time.

In response to the above problems related to removal of substantially all toner from toner cartridges, various devices and procedures have been developed to aid the flow and removal of toners from toner cartridges. One effective procedure when performed correctly is simply the shaking or other agitation of a toner cartridge by human operators prior to mating the cartridge with the printing machine receptacle. However, while such agitation if done correctly usually solves the root problem of breaking apart clumps and bridges, it exacerbates the second problem of poor visibility by increasing electrostatic charges attracting a layer of toner to walls of the cartridge. Moreover, much experience confirms that many operators do not read the instructions and do not know or remember that toner cartridges need to be shaken. Even when operators read instructions, humans inevitably interpret product instructions subjectively such that an instruction to "vigorously agitate" a cartridge may lead to too much force by a few operators and too little by others. In the absence of being able to see whether in fact all of the toner has flowed out of the cartridge, the result is that some cartridges are shaken or pounded hard enough to be damaged while others are not shaken enough to break up clumps and bridges that may have formed. Once the cartridge is mated to the receiving receptacle while the operator is uncertain whether toner particles remain clumped and bridged, the operator is left with several choices: One is to leave the cartridge as is and to risk wasting toner and/or believing that the printing system is consuming too much toner. A second choice is removal of the cartridge with its seals open, thereby risking contaminating the toner itself plus spilling the difficult-to-clean particles. A third choice is to try to strike, squeeze, or otherwise agitate the toner cartridge in situ. In addition to the probability that some toner nevertheless remains within the cartridge, such agitation in situ risks damage to the mating receptacle and associated parts of the printing machine. The end result is a frequent waste of valuable toner and a resulting increase in the costs of operating the printing machines plus the risk of warranty and service events.

Manufacturers of printing and other systems understand that human operators do not always follow instructions or perform the instructed activities correctly. In effect, humans are inherently uncontrollable elements when asked to perform control processes. Accordingly, a number of solutions have been developed to more fully automate removal of toner from toner cartridges. For toner cartridges that are mounted onto printing machines in order that toner be extracted in a regulated fashion, such cartridges are now often cylindrical in shape with spiral ribs located on the inside peripheral walls of the cartridges. An example of such prior art cartridges is shown in U.S. Pat. No. 5,495,323 issued to Meetze incorporated and is hereby incorporated by reference. See also, U.S. Pat. No. 5,903,806 issued to Matsuoka et al. and U.S. Pat. No. 5,576,816 issued to Staudt et al. that both disclose substantially cylindrical toner cartridges having on their peripheral surface a spiral groove. The toner cartridge and the receiving apparatus operate to rotate the cartridge and to thereby transport the toner within the spiral groove. The apparatus includes a supplying element in the form of an opening and a regulating device. Although toner cartridges with such spiral grooves are effective in urging toner toward the mouth of the cartridge, such grooves by themselves do little to break up the clumps or bridging described above. Even when the apparatus includes a probe, auger, or similar device that penetrates the stored toner in a cartridge, current designs place such probes only along the central axis of the cartridge. Toner clumped or agglomerated along the periphery of the toner cartridge may not be jostled or mixed by either the rotation of the cartridge or by the probe itself. Without the ability to see into the cartridge, an operator often remains uncertain whether all toner has been removed.

At least one prior art device employed a helical member such as a spring inside the toner cartridge for the express purpose of breaking up clumps, bridges, and other agglomerations. In U.S. Pat. No. 4,739,907, issued to Gallant, a cylindrical toner cartridge includes a dispensing opening at one end and an integral toner transport, mixing, and anti-bridging member rotatably supported within the container. The transport, mixing, and anti-bridging member comprises a first coiled spring element having a cross section substantially the same as the cross section of the cartridge and freely rotatable therein, which spring is wound in the direction to transport toner along its length toward the dispensing opening. The member also comprises a second coiled spring element having a cross section substantially smaller than the first spring element but being substantially concentrically positioned and being attached to the first spring element but wound in a direction opposite to the first spring element. In this manner, rotation of the cartridge while the spring members remain substantially fixed results in the scraping of clumped toner from the sides of the cartridge and mixing and penetration of any agglomerations and bridges within the interior of the cartridge by the inner spring.

One limitation to the above prior art cartridges and devices is that each is designed to work in or in conjunction with toner cartridges that rotate once mated to a toner receptacle on the printing machine. Without rotation of the cartridge, neither spiral grooves nor fixedly located springs actively engage toner particles within the cartridge. Additionally, recent advances in imaging and toner production has led to smaller toner particles that now may average less than 10 microns. In order to overcome electrostatic forces that tend to attract particles together and to the toner cartridge itself, a substantial amount of agitation and aeration of the toner particles is preferred. Such agitation, as explained above, exacerbates the inability to see into the cartridge. It would be advantageous, therefore, to devise a toner cartridge assembly that cleans at least a small region of the cartridge sufficiently to enable a human operator to peer inside the cartridge.

Although the above background for the present invention and several of its embodiments are explained in relation to toner cartridges, the present invention is believed to have wide applicability to any container of material, especially particulate or granulated matter prone to settle and clump or materials prone to congeal during storage or handling and that need to be completely removed thereafter from their container.

SUMMARY OF THE INVENTION

One embodiment of the present invention is a mechanism for increasing visibility through a portion of the inside surface of a container that holds particulate matter, comprising: (a) a drive mechanism having a movable member positioned to be moved by the drive mechanism along the inside surface of the container; (b) a cleaning member, connected to the movable member and positioned to travel proximately to the inside surface of the container when the movable member is moved; and (c) a switching mechanism, cooperating with the drive mechanism, for activating movement of the movable member by the drive mechanism.

Another embodiment of the present invention is a process for increasing visibility through a portion of the inside surface of a container that holds particulate matter, comprising: (a) connecting a cleaning member with a movable member of a drive mechanism; (b) positioning the movable member such that the connected cleaning member moves proximately to the inside surface of the container when the movable member moves; and (c) activating the drive mechanism to move the movable member.

Yet another embodiment of the present invention is a cartridge for storing marking materials, said cartridge having an inside surface, comprising: (a) a drive mechanism having a movable member positioned to be moved by the drive mechanism along the inside surface of the cartridge; (b) a cleaning member, connected to the movable member and positioned to travel proximately to the inside surface of the cartridge when the movable member is moved; and (c) a switching mechanism, cooperating with the drive mechanism, for activating movement of the movable member by the drive mechanism.

DETAILED DESCRIPTION OF THE DRAWINGS

While the present invention will hereinafter be described in connection with several embodiments and methods of use, it will be understood that this is not intended to limit the invention to these embodiments and methods of use. On the contrary, the following description is intended to cover all alternatives, modifications and equivalents, as may be included within the spirit and scope of the invention as defined by the appended claims.

Figure 1:
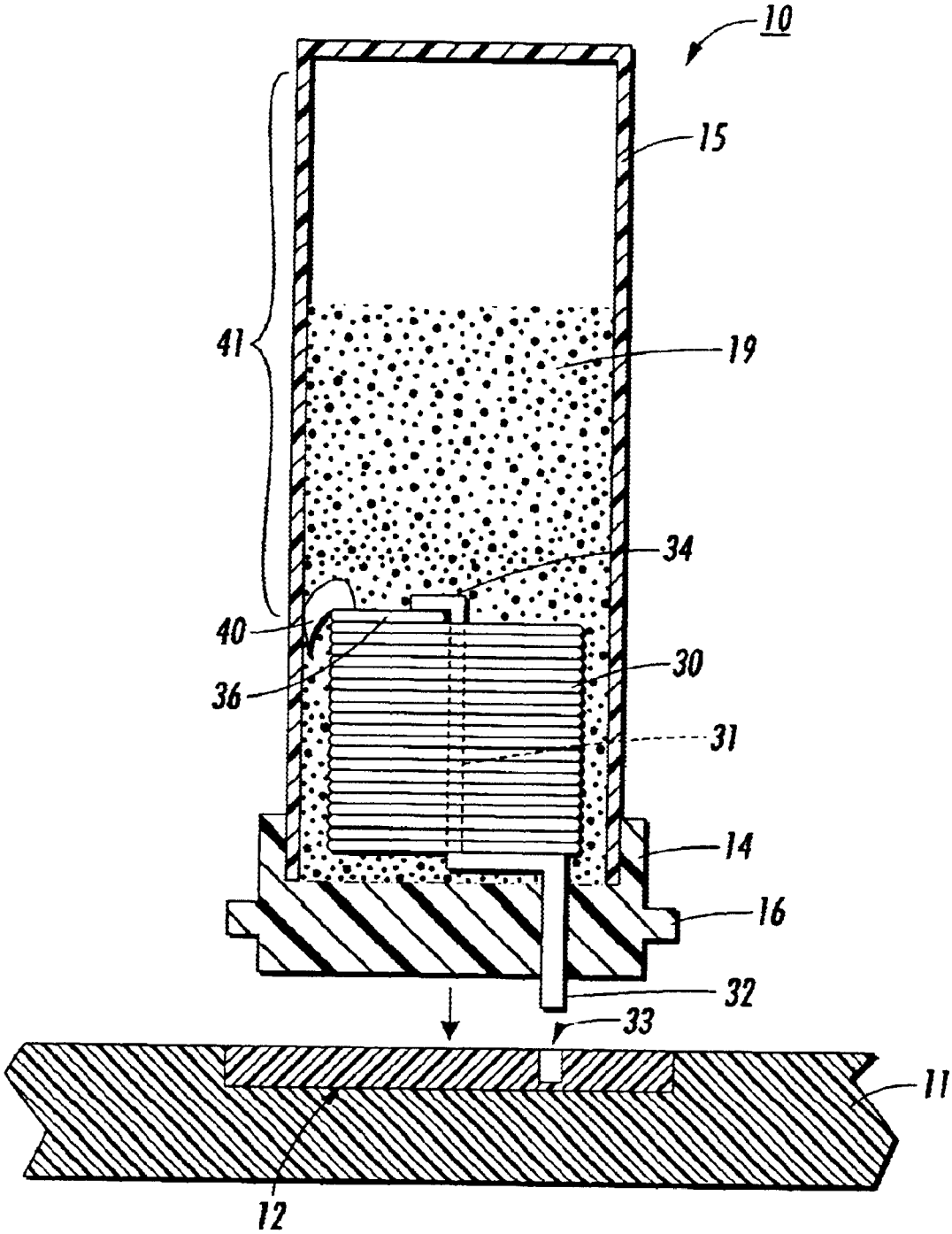
FIG. 1 is an elevated cross-sectional view of an exemplary compression spring embodiment of the present invention.
Figure 2:
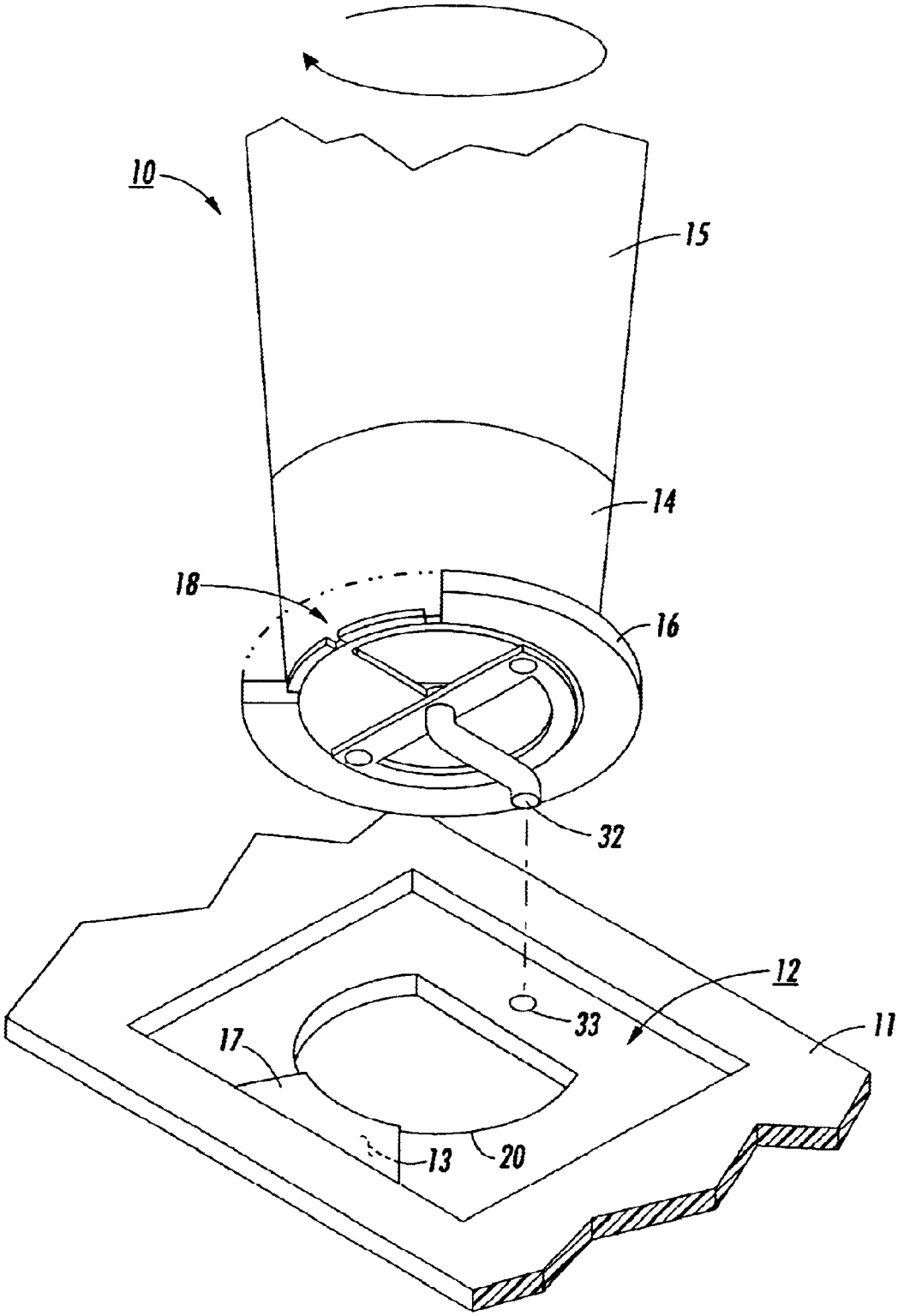
FIG. 2 is an elevated perspective close-up view of a container cap together with a printing system mating receptacle for such cap.

Turning now to FIG. 1, one embodiment of the present invention is shown. In this elevated cross-sectional view of an exemplary toner cartridge 10 of the present invention, the toner cartridge or container 10 is shown positioned above a mating apparatus 12 of a printing machine (not shown). In this embodiment, toner cartridge 10 comprises a clear or translucent cylindrical bottle 15 that is typically comprised of a thermoplastic material such as PVC. The toner cartridge 10 is sealed at its bottom end with a container cap 14 that is also typically made from thermoplastic resin. Turning to FIG. 2, an elevated close-up view of container cap 14 is shown. In this embodiment, a flange 16 is formed proximate to the base of container cap 14. Flange 16 encircles most but not all of the circumference of container cap 14. In this manner, at least one gap is located on flange 16. The role of flange 16 and its gaps will be discussed in conjunction with a description of mating apparatus 12 below.

Returning to FIG. 1, mating apparatus 12 is shown in a cross-sectional view. Mating apparatus 12 serves two functions: 1) it forms the receiving aperture 20 (FIG. 2) to a toner receptacle 11 of the printing system wherein toner is stored prior to delivery to a development station of the printing system, and 2) it mates tightly with toner cartridge 10 in order that toner can be transferred from toner cartridge 10 into toner receptacle 11 without spills or seepage of toner particles into the air or onto the neighboring surfaces of the printing system. Mating apparatus 12 may take a wide variety of forms. Returning to FIG. 2, one embodiment of a mating apparatus 12 is shown in an elevated perspective view. In this view, mating apparatus 12 comprises, in addition to its receiving aperture 20 into the toner receptacle 11, at least one mating fixture 17 comprising a negatively sloped overhang surface 13. In order for toner cartridge 10 to be fully pressed into position on mating apparatus 12, flange 16 of toner cartridge 10 must be positioned such that gap 18 in flange 16 aligns with mating fixture 17. In this manner, container cap 14 can slide past mating fixture 17 to rest firmly over the rim of receiving aperture 20. Once toner cartridge 10 is so aligned and rested upon the rim of receiving aperture 20, the operator can rotate the toner cartridge 10 in place in a clockwise fashion (see arrow in FIG. 2). During such rotation, flange 16 of container cap 14 engages the leading edge of mating fixture 17. As toner cartridge 10 is further rotated, the mating fixture 17 presses flange 16 downward. Such downward pressure forces container cap 14 more firmly upon the rim of receiving aperture 20, thereby ensuring a tight seal between toner cartridge 10 and toner receptacle 11.

The apparatus within bottle 15 and its container cap 14 will now be explained in relation to FIG. 1. As is conventional with toner cartridges, most of the volume of bottle 15 is filled with particles of toner labeled in FIG. 1 as 19. As discussed above, toner particles 19 may comprise any pelletized or granulated substance including, without limitation, pelletized waxy ink materials, other marking materials and pelletized materials such as thermoplastic resin pellets. FIG. 1 shows, toner particles 19 that have settled during shipment and storage such that a considerable volume of bottle 15 is vacant of particulate matter. As described above, it is also common that particles such as toner will clump or form bridges within the toner cartridges and may therefore not settle in a uniform fashion or may clump with non-uniform density.

FIG. 1 shows toner cleaning member 40 attached to movable member 36 portion of drive mechanism 30. As will be explained below, cleaning member 40 will be moved along the interior surface of bottle 15 once drive mechanism 30 has been released. In the course of such movement, cleaning member 40 is designed to sweep and clean toner particles along its path. Such cleaning is performed by several possible interactions. First cleaning member 40 sweeps toner along its path. Secondly, cleaning member 40 may be made of absorbent material such that some toner particles are absorbed. Thirdly, many toner particles will stick to cleaning member 40. Lastly and perhaps most importantly, cleaning member 40 may be doped with an electrostatic neutralizer such that the wall region 41 of bottle 15 through which it sweeps will become uncharged or charged oppositely from the toner particles 19 themselves. The result is that toner particles 19 will not be attracted to this region 41. Region 41 will therefore remain clear after it has been swept by cleaning member 40, thereby allowing an operator to peer into toner cartridge 10 to determine how much of the toner has flowed from the toner cartridge 10.

One embodiment of drive mechanism 30 is shown in FIG. 1 as a simple coiled compression spring in its fully compressed position. Such drive mechanism 30 may take many forms, including, without limitation, negator springs, tension springs, compressed foam, leaf springs, rubber bands or any other mechanical or electro-mechanical device that stores potential energy and that can be released to cause rapid movement of cleaning member 40 along the wall of bottle 15. One requirement of a drive mechanism 30 is that it comprise a movable member 36 inside the container to be cleaned, such movable member 36 being positioned for movement along the inside surface of the container when driven by the drive mechanism 30. It should be noted that although FIG. 1 shows drive mechanism 30 in its pre-release position compressed proximate to container cap 14, drive mechanism 30 could also be located at the top of bottle 15. Also, as will be shown below in FIG. 6, drive mechanism 30 could store its potential energy in a fully extended position under tension. When released, such a device would contract, thereby imparting the desired drive motion to move cleaning member 40 through region 41.

In order to keep cleaning member 40 proximate to region 41 of the wall of bottle 15, cleaning member 40 typically fills the gap between drive mechanism 30 and region 41. For drive mechanisms that may not necessarily conform to the shape of bottle 15 in the same manner as drive mechanism 30, then cleaning member 40 itself may be shaped such that at least a portion of its surface is proximate to region 41 during the path of its travel. Alternatively, drive mechanism 30 may be designed in any other manner that maintains cleaning member 40 proximate to region 41 during its path of travel. If desired, region 41 may include the entire circumference of bottle 15. The minimum size requirement of region 41 is determined by the size and shape desired for visibility.

FIG. 1 also shows a switching or lock-down mechanism 31 that is used to control the time at which drive mechanism 30 is set in motion. In the embodiment shown, this lock-down mechanism 31 comprises a simple metal bar extending over the top of coiled drive mechanism 30. At least a portion 32 of lock-down mechanism 31 is designed to engage a fixture 33 located on mating apparatus 12. In the embodiment shown, lock-down mechanism 31 is a bar that terminates in a locking and locking pin 32. This locating pin 32 extends below container cap 14. Fixture 33 is a relatively small receiving port that operates with a shape conforming to locking pin 32. In this manner, pin 32 and fixture 33 supplement the gap 18 in flange 16 for positioning toner cartridge 10 precisely over the rim of receiving aperture 20. Moreover, once pin 32 is inserted into fixture 33, pin 32 is prevented from sliding during rotational movement of toner cartridge 10 as discussed below.

Figure 3:
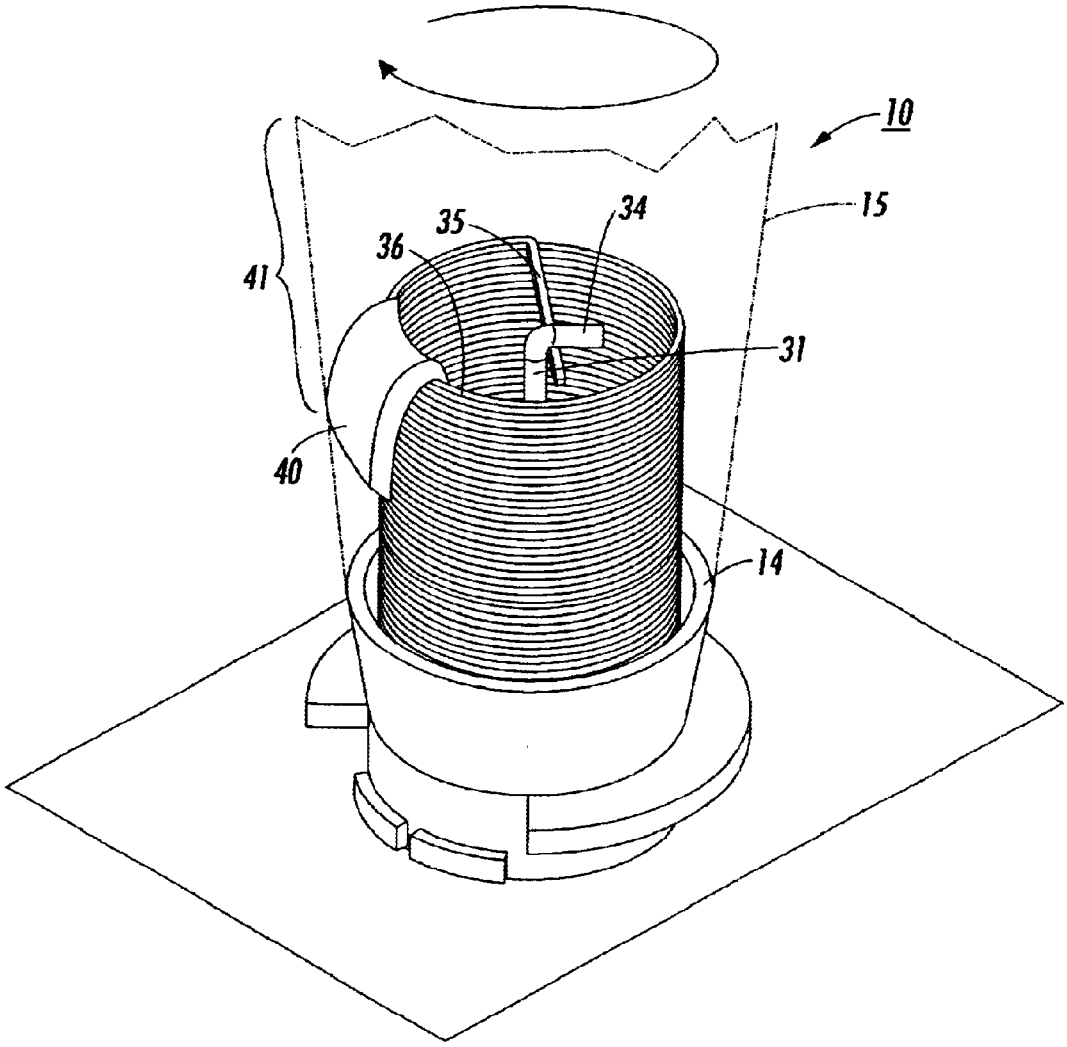
FIG. 3 is an elevated perspective view of the top of an agitating device embodiment of the present invention in its compressed position. The agitating device is attached to a container cap that is mated with a printing system.

Additional information regarding the lock-down function of lock-down mechanism 31 is shown in FIG. 3, which is an elevated perspective view of the top of drive mechanism 30 in its compressed position. For clarity, toner cartridge 10 has been cut away in FIG. 3 in order to better reveal the relationship between lock-down mechanism 31 and drive mechanism 30. As shown, the top portion of the lock-down mechanism 31 terminates with an L-shaped bend and an extension section 34 that extends essentially horizontally. Extension section 34, in turn, engages cross member wire 35. Cross member wire 35 comprises one embodiment of a releasing mechanism that, when combined with lock-down mechanism 31, forms a type of switch. In the embodiment shown, cross member wire 35 is simply the terminal segment of drive mechanism 30 that, in this embodiment, comprises a drive mechanism. Cross member wire 35 has been bent to essentially bisect the circumference of the spring 30. Since, in this embodiment, lock-down mechanism 31 is vertically positioned at approximately the center of the spring diameter, extension section 34 engages cross member wire 35 approximately in the middle of drive mechanism 30.

As discussed above in relation to FIG. 2, this embodiment of the present invention requires that the operator rotate toner cartridge 10 in order to firmly press the toner cartridge 10 against receiving aperture 20. During such rotation, as described above, locking pin 32 is mated with fixture 33 with the result that lock-down mechanism 31 cannot rotate. Since cross member wire 35 is attached to drive mechanism 30 and since the drive mechanism is fixedly attached to toner cartridge cap 14, the orientation of cross member wire 35 in relation to extension section 34 of lock-down mechanism 31 changes during rotation of toner cartridge 10.

Figure 4:
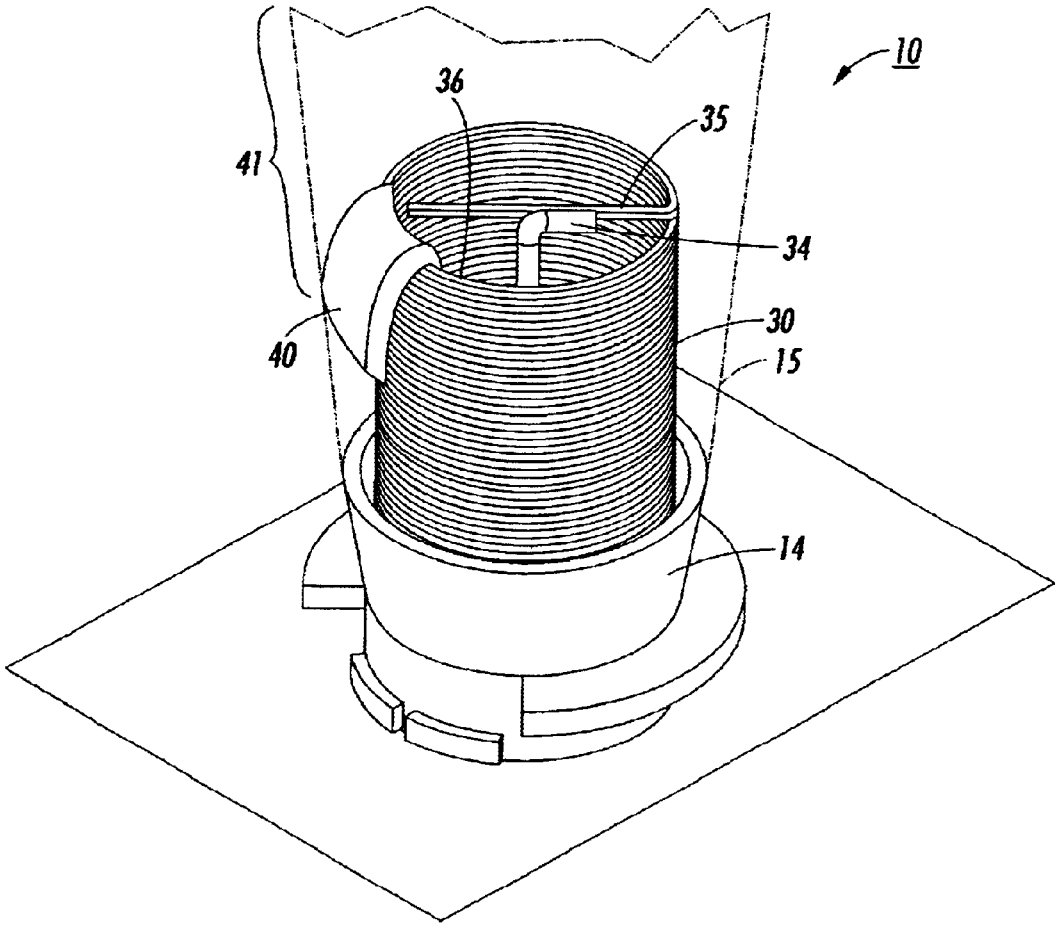
FIG. 4 is an elevated perspective view of a lock-down mechanism of the present invention after a change in its orientation in relation to a releasing mechanism.

FIG. 4 shows the change in orientation between cross member wire 35 and extension section 34 after container 10 is rotated approximately 90 degrees. As shown, extension section 34 no longer engages onto cross member wire 35. The result is that the potential energy stored in drive mechanism 30 is released. In the embodiment shown, it is free to spring into its extended position. As drive mechanism 30 travels to its extended position, it drags cleaning member 40 through region 41, thereby effecting the cleaning.

Figure 5:
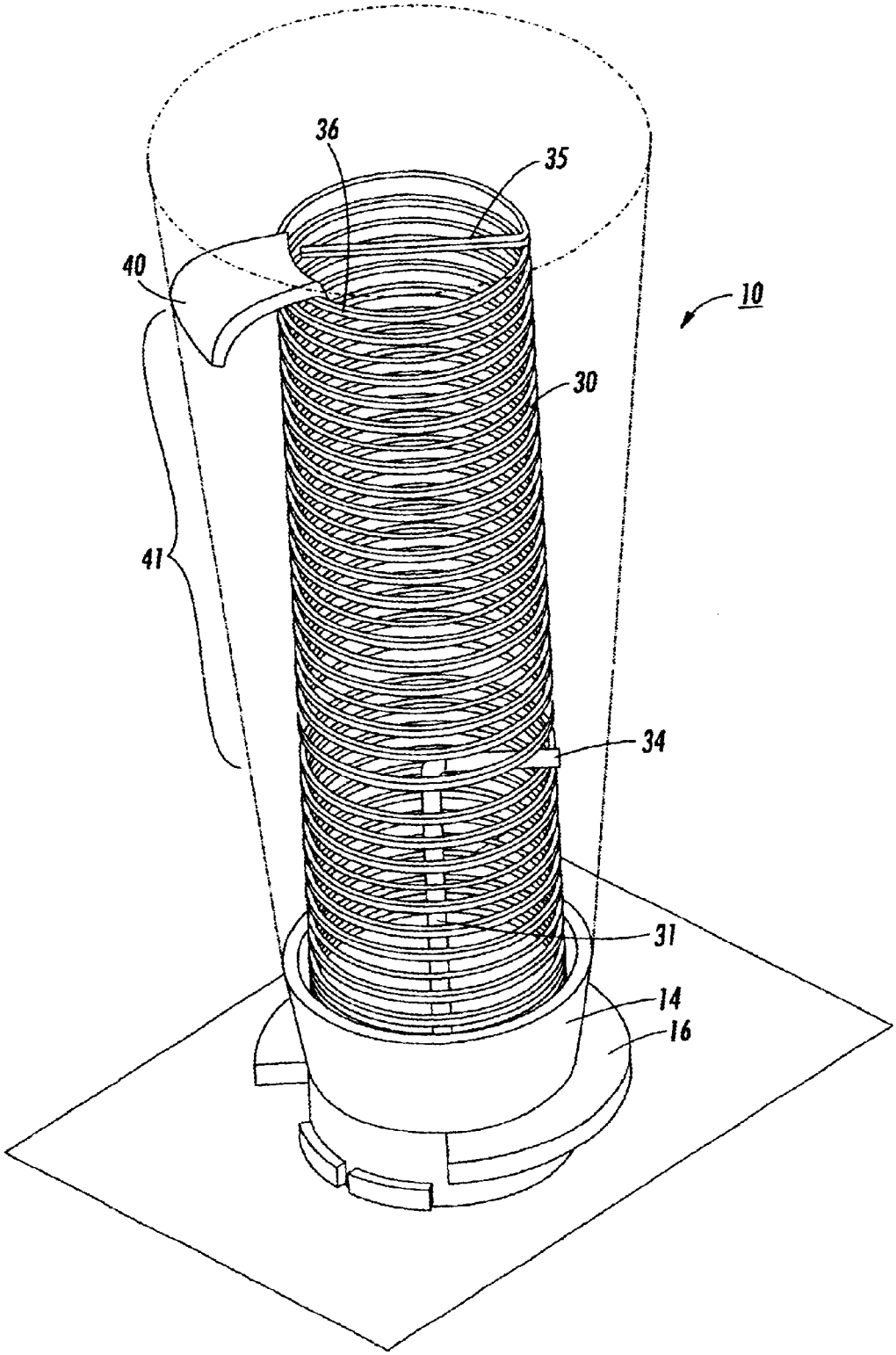
FIG. 5 is an elevated side view of an agitating device of the present invention in its extended position after release from its lock-down mechanism.

Turning now to FIG. 5, drive mechanism 30 is shown in its extended position after its release from lock-down mechanism 31. In the embodiment shown, the coiled metal compression spring that comprises drive mechanism 30 expands until the spring reaches its full extension. Release of the stored potential energy in such coiled metal spring typically carries its full extension beyond its final rest position shown in FIG. 5. The result is an advantageous oscillating motion that dampens into the final rest position shown in FIG. 5. Such oscillating motion serves to further engage cleaning member 40 with region 41, thereby increasing the cleaning opportunity of cleaning member 41. In effect, therefore, the described embodiment of the present invention shows a drive mechanism 30 that releases its stored potential energy in a primary single stroke, such single stroke motion having secondary oscillating motions that continue the cleaning action of cleaning member 40 until all potential energy has been expended.

The characteristics of cleaning member 40 will now be discussed. Its basic characteristic is that cleaning member 40 should remove toner from region 41. As described above, such cleaning member 40 may work by any or all of sweeping action, absorption of toner particles, adherence of toner particles to the cleaning member 40, and, most effectively, by making region 41 electrostatically neutral or repulsive to toner particles. Sweeping action can be performed, without limitation, by simple flexible blades operating either with a shoveling motion or in a doctoring mode. Absorption of toner particles can similarly be accomplished by many methods, including sponges and hoppers that may receive toners swept upwards by sweeping blades. Any number of materials could also clean by sticking to toner particles as cleaning member 40 moves through region 41. For instance, a tacky roller member may suffice. In order to produce electrostatic neutrality or repulsion of toner particles, various methods are also possible. Neutrality can be largely accomplished by forming cleaning member 40 of an electrically conductive material that is grounded, perhaps through drive mechanism 30. Repulsion can be accomplished by inducing within region 41 ions carrying the same charge as the triboelectrically charged toner particles. For instance, if the toners take a negative charge, then cationic ammonium compounds common to many household laundry softeners will suffice. See, for instance, U.S. Pat. No. 5,574,179 issued to Wahl et al. and the prior art cited therein. If the toners take a positive charge, then wiping with anionic compounds will suffice to draw electrons out of region 41 and to thereby induce a repulsive positive charge.

The embodiment of cleaning member 40 shown in FIGS. 1 and 3–5 comprises a sponge swab doped with either cationic or anionic compounds. While its primary cleaning action is through creation of repulsive electrical charges, some sweeping and sticking action occurs. If the sponge is porous, some absorption also occurs. In the embodiment shown, region 41 is approximately 0.5 inches wide. This is wide enough to permit an operator to peer inside. As discussed above, region 41 could be made in any height and any width, including a width encompassing the entire circumference, as long as the region 41 is large enough to permit the intended visibility. When comparing FIG. 1 to FIG. 5, it should be noted that the space between region 41 and drive mechanism 30 increases as the bottle 15 widens. Accordingly, cleaning member 40 is initially stored in a compressed, downwardly bent position that expands and unbends as drive mechanism 30 causes it to travel along region 41. The net effect is that cleaning member 40 remains in contact with region 41 throughout its travel.

Figure 6:
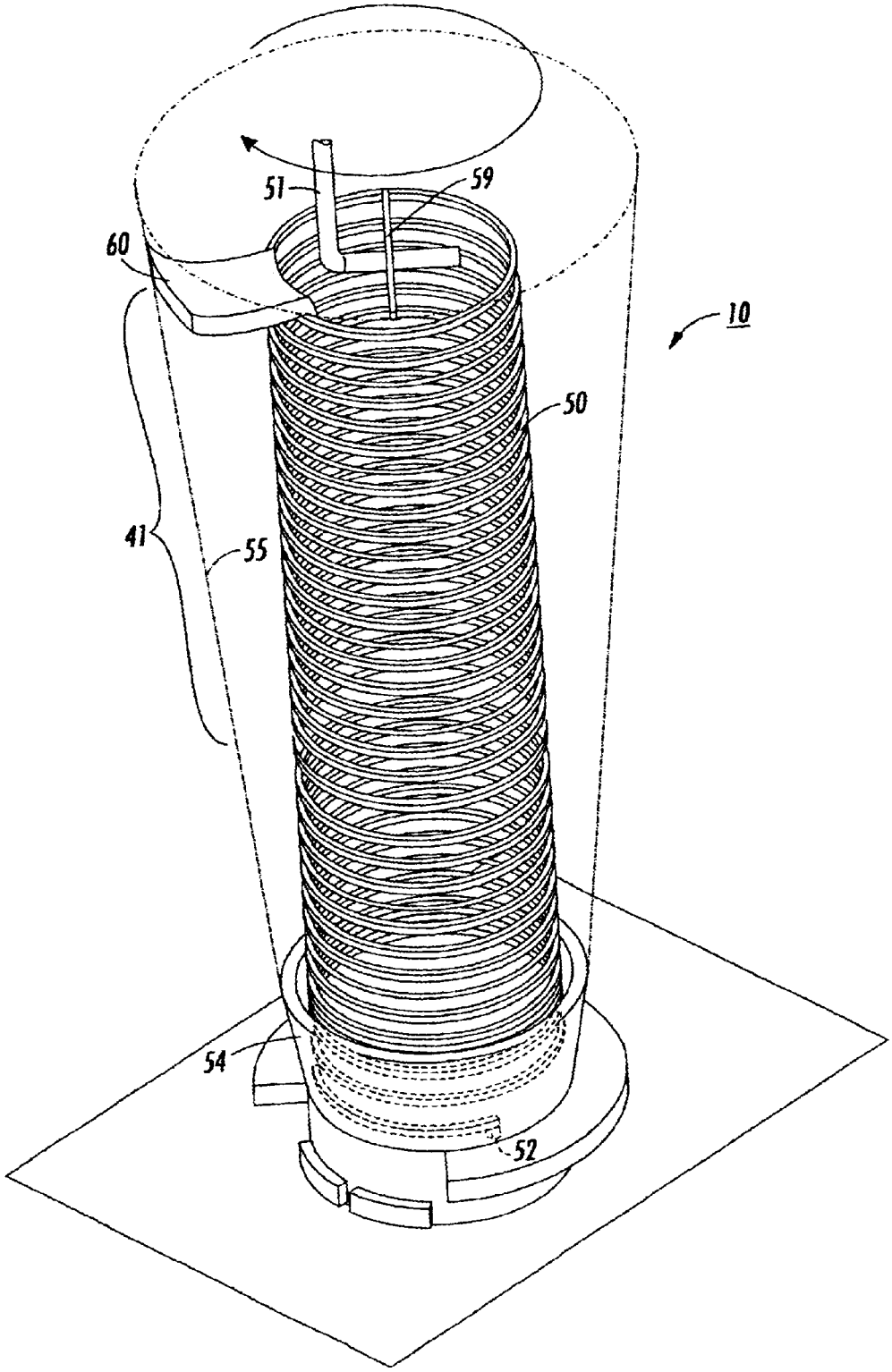
FIG. 6 is an elevated cross-sectional view of an exemplary tension spring embodiment of the present invention.

Turning now to FIG. 6, an embodiment of the present invention is shown in which a drive mechanism stores potential energy under tension rather than compression. This embodiment closely resembles the embodiment in FIGS. 1–5 except that the drive mechanism 50 in FIG. 6 is a coiled spring stored under tension. Lock-down device 51 is a simple hook formed in the plastic of toner bottle 55. The coiled spring terminates in a release mechanism 59 identical to release mechanism 35 shown in FIG. 3, which is the terminal portion of drive mechanism 50 bent to bisect the circumference of drive mechanism 50. In contrast to the embodiment of FIG. 1, drove mechanism 50 and its release mechanism 59 are prevented from rotating rather than lock-down device 51 being prevented from rotating. Such fixed orientation of drive mechanism 50 is determined by a locking pin 52 that operates similarly to the locking pin 32 of FIG. 1. When bottle 55 is rotated in the manner described above, lock-down device 51, which is fixedly molded into bottle 55, rotates in relation to release mechanism 59. The result is that after sufficient rotation of bottle 55 and its attached lock-down device 51, release mechanism 59 slips free from lock-down device 51, and drive mechanism 50 releases its potential energy by rapid compressive motion toward the container cap 54. As in the embodiment shown in FIGS. 1–5, release of the potential energy in the drive mechanism 50 causes movement of a clearing member 60. In this embodiment as in the embodiment shown in FIGS. 1–5, clearing member 60 is comprised of a compressed and slightly bent sponge doped with either anionic or cationic compounds. As the coils of drive mechanism 50 are pulled toward container cap 54, cleaning member 60 presses upon region 41 to sweep and absorb toner from the region 41. More importantly, as cleaning member 60 sweeps or wipes region 41 clean, the anionic or cationic compounds charge region 41 oppositely from the toner particles in the bottle 55. The result is that region 41 is cleaned and remains clean during such time as its surface remains repulsive to the toners. One possible advantage of the embodiment shown in FIG. 6 over the embodiment shown in FIGS. 1–5 is that the motion of drive mechanism 50 and cleaning member 60 is primarily in the direction of container cap 54 and receiving aperture 20 of toner receptacle 11. Materials are thus urged toward the opening through which they are intended to flow.

As will be understood from the embodiments of FIGS. 1–5 and of FIG. 6, many variations of the present invention are possible. As discussed above, any number of devices capable of storing potential energy may operate to move cleaning members such as device 40 in FIGS. 1–5 and cleaning member 60 of FIG. 6. In FIG. 6, where the drive mechanism 50 stores potential energy under tension, elastic devices such as rubber bands are particularly suited for use in the present invention. Also as described above, cleaning members 40 and 60 may assume any number of shapes and be comprised of a wide variety of substances. Both drive mechanisms 30, 50 and cleaning members 40, 60 of the present invention may be adapted for various container shapes and particulate characteristics, including electrical charge characteristics, if any.

In review, the self-cleaning mechanism of the present invention includes a drive mechanism that stores potential energy capable of being released inside a container or other vessel holding particulate matter. When released, the drive mechanism propels a cleaning member along the sides of the container with the result that at least a small region is cleaned sufficiently for an operator to peer inside in order to determine how much, if any, of the particulate matter remains in the container. When applied to cartridges for containing toner, the present invention can be implemented for relatively minor cost while increasing customer satisfaction and preventing at least some warranty and service events.

It is, therefore, evident that there has been provided in accordance with the present invention a self-cleaning mechanism for use in a container, such mechanism fully satisfying the aims and advantages set forth above. While the invention has been described in conjunction with several embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A mechanism for increasing visibility through a portion of the inside surface of a container that holds particulate matter, comprising:

a. a drive mechanism having a movable member positioned to be moved by the drive mechanism along the inside surface of the container;

b. a cleaning member, connected to the movable member and positioned to travel proximately to the inside surface of the container when the movable member is moved; and c. a switching mechanism, cooperating with the drive mechanism, for activating movement of the movable member by the drive mechanism.

2. The mechanism of claim 1, wherein the particulate matter being held in the container comprises marking material.

3. The mechanism of claim 2, wherein the marking material comprises electrophotographic toner particles.

4. The mechanism of claim 2, wherein the marking material comprises dry ink jet solid ink.

5. The mechanism of claim 1, wherein the drive mechanism moves the movable member is a single stroke.

6. The mechanism of claim 1, wherein the drive mechanism is located primarily within the container.

7. The mechanism of claim 1, wherein the drive mechanism is powered by stored potential energy.

8. The mechanism of claim 1, wherein the drive mechanism comprises a spring.

9. The mechanism of claim 1, wherein the drive mechanism comprises a coiled spring.

10. The mechanism of claim 1, wherein:

a. the container has a height dimension running generally between a top portion and a bottom portion; and b. the drive mechanism drives the movable member primarily along the height dimension.

11. The mechanism of claim 1, wherein the drive mechanism drives the movable member in an oscillating motion.

12. The mechanism of claim 1, wherein:

a. the container has a lateral dimension running generally parallel to a top and a bottom of the container; and b. the drive mechanism drives the movable member along the lateral dimension.

13. The mechanism of claim 1, wherein the cleaning member cleans by sweeping.

14. The mechanism of claim 1, wherein the cleaning member cleans by absorption.

15. The mechanism of claim 1, wherein the cleaning member cleans by attracting the particulate matter.

16. The mechanism of claim 1, wherein the cleaning member cleans by use of electrostatic forces.

17. The mechanism of claim 16, wherein the cleaning member further comprises an anionic compound.

18. The mechanism of claim 16, wherein the cleaning member further comprises a cationic compound.

19. The mechanism of claim 1, wherein the cleaning member comprises a sponge.

20. The mechanism of claim 1, wherein the cleaning member changes shape during movement in a manner that maintains its position proximate to the inside surface of the container.

21. The mechanism of claim 1, wherein the switching mechanism comprises:

a. a lock-down mechanism; and b. a releasing mechanism.

22. A process for increasing visibility through a portion of the inside surface of a container that holds particulate matter, comprising:

a. connecting a cleaning member with a movable member of a drive mechanism;

b. positioning the movable member such that the connected cleaning member moves proximately to the inside surface of the container when the movable member moves; and c. activating the drive mechanism to move the movable member.

23. A cartridge for storing marking materials, said cartridge having an inside surface, comprising:

a. a drive mechanism having a movable member positioned to be moved by the drive mechanism along the inside surface of the cartridge;

b. a cleaning member, connected to the movable member and positioned to travel proximately to the inside surface of the cartridge when the movable member is moved; and c. a switching mechanism, cooperating with the drive mechanism, for activating movement of the movable member by the drive mechanism.

24. The cartridge of claim 23, wherein the stored marking materials are electrophotographic toners.

25. The cartridge of claim 23, wherein the stored marking materials are solid ink for a dry ink jet marking engine.

* * * * *